US010135555B2

(12) United States Patent
Zhang et al.

(10) Patent No.: US 10,135,555 B2
(45) Date of Patent: Nov. 20, 2018

(54) MONITORING BEHAVIOR OF LISTENING TO BROADCAST

(71) Applicant: Nielsen-CCData Media Research Co., Ltd., Zhejiang (CN)

(72) Inventors: Hong Zhang, Beijing (CN); Hao Jia, Beijing (CN); Shijun Liu, Beijing (CN); Haiyu Wang, Beijing (CN)

(73) Assignee: Nielsen-CCData Media Research Co., Ltd., Zhejiang (CN)

( * ) Notice: Subject to any disclaimer, the term of this patent is extended or adjusted under 35 U.S.C. 154(b) by 0 days.

(21) Appl. No.: 15/436,260

(22) Filed: Feb. 17, 2017

(65) Prior Publication Data

US 2017/0243601 A1 Aug. 24, 2017

(30) Foreign Application Priority Data

Feb. 18, 2016 (CN) ..... 2016 1 0091566

(51) Int. Cl.

| | |
|---|---|
| ***H04H 60/21*** | (2008.01) |
| ***H04H 60/37*** | (2008.01) |
| ***H04H 60/43*** | (2008.01) |
| ***H04H 60/58*** | (2008.01) |

(52) U.S. Cl.

CPC ..... *H04H 60/37* (2013.01); *H04H 60/43* (2013.01); *H04H 60/58* (2013.01)

(58) Field of Classification Search

CPC ..... H04H 60/32; H04H 60/33; H04H 60/37; H04H 60/40; H04H 60/43; H04H 60/44; H04H 60/46; H04H 60/48; H04H 60/58; H04H 60/66

See application file for complete search history.

(56) References Cited

U.S. PATENT DOCUMENTS

| | | | | |
|---|---|---|---|---|
| 5,630,203 | A * | 5/1997 | Weinblatt ..... | H04H 20/31 455/2.01 |
| 5,819,155 | A * | 10/1998 | Worthy ..... | H04H 60/44 455/2.01 |
| 2014/0282640 | A1* | 9/2014 | Nielsen ..... | H04N 21/442 725/9 |
| 2014/0343703 | A1* | 11/2014 | Topchy ..... | G06F 17/30743 700/94 |

* cited by examiner

*Primary Examiner* — Duc Nguyen
*Assistant Examiner* — Kile Blair
(74) *Attorney, Agent, or Firm* — Miller, Matthias & Hull LLP

(57) ABSTRACT

A device and a method for monitoring behavior of listening to broadcast comprises a transmitter transmitting a characteristic audio signal which is modulated on a carrier signal; a collector collecting an ambient sound; a detector detecting whether the collected ambient sound contains the characteristic audio signal; and a determiner determining whether a broadcast receiving apparatus receives the broadcasting channel corresponding to frequency of the carrier signal according to the result of the detector.

14 Claims, 5 Drawing Sheets

MONITORING BEHAVIOR OF LISTENING TO BROADCAST

BACKGROUND

The broadcast users listen to broadcasting channels through broadcast receiving apparatus (such as radio etc.). The information related to broadcast users' behavior of listening to broadcast is valuable information, so a technological mean of effectively monitoring behaviors of listening to broadcast is needed.

The present disclosure is directed to methods and system that may eliminate certain shortcomings, as noted above or otherwise. However, it should be appreciated that such a benefit is neither a limitation on the scope of the disclosed principles nor of the attached claims, except to the extent expressly noted in the claims. Additionally, the discussion of technology in this Background section is reflective of the inventors' own observations, considerations, and thoughts, and is in no way intended to accurately catalog or comprehensively summarize the art currently in the public domain. As such, the inventors expressly disclaim this section as admitted or assumed prior art. Moreover, any identification or implication above or otherwise herein of a desirable course of action reflects the inventors' own observations and ideas, and should not be assumed to indicate an art-recognized desirability.

SUMMARY

The invention presents a device and a method for monitoring behavior of listening to broadcast effectively.

According to an aspect of the present invention, there is provided a device for monitoring listening to broadcast. The device comprises a transmitter transmitting a characteristic audio signal which is modulated on a carrier signal; a collector collecting an ambient sound; a detector detecting whether the collected ambient sound contains the characteristic audio signal; and a determiner determining whether a broadcast receiving apparatus receives the broadcasting channel corresponding to frequency of the carrier signal according to the result of the detector.

According to another aspect of the present invention, there is provided a device for monitoring listening to broadcast. The device comprises a transmitter transmitting a characteristic audio signal which is modulated on a carrier signal; a collector collecting a ambient sound; a processor detecting whether the collected ambient sound contains the characteristic audio signals; and determining whether a broadcast receiving apparatus receives the broadcasting channel corresponding to frequency of the carrier signal according to the result of the detecting.

According to another aspect of the present invention, there is provided a method for monitoring listening to broadcast. The method comprises transmitting a characteristic audio signal which is modulated on a carrier signal; collecting an ambient sound; detecting whether the collected ambient sound contains the characteristic audio signal; and determining whether a broadcast receiving apparatus receives the broadcasting channel corresponding to frequency of the carrier signal according to the result of detecting.

The features, functions, and advantages disclosed herein can be achieved independently in various embodiments or may be combined in yet other embodiments, the details of which may be better appreciated with reference to the following description and drawings.

BRIEF DESCRIPTION OF THE DRAWINGS

Hereinafter, the present invention will be described more fully with reference to the drawings in order to gain a sufficient understanding of the present invention, the merits thereof, and the objectives accomplished by the embodiments of the present invention, wherein the same reference label usually represent the same components in exemplary embodiments of the present invention.

Figure 1:
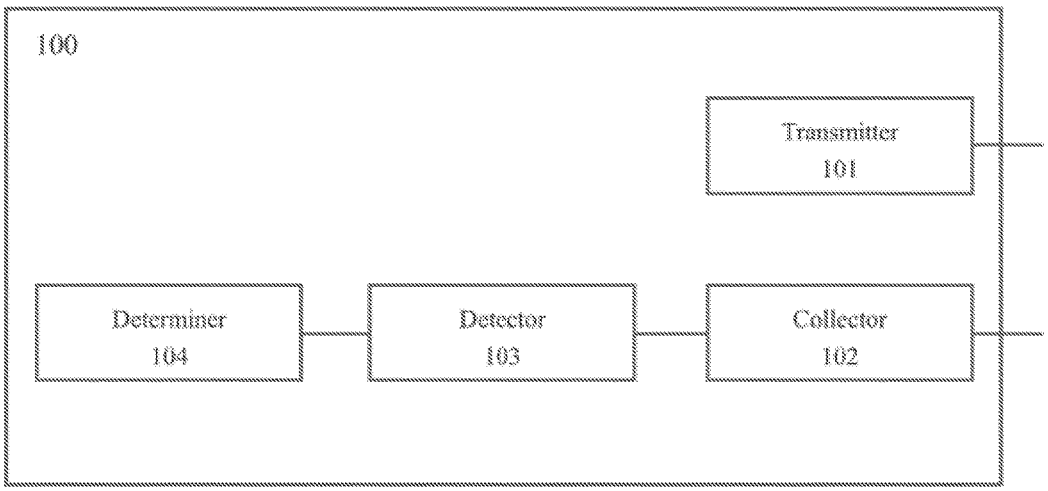
FIG. 1 shows a block diagram of an embodiment of the device for monitoring behavior of listening to broadcast disclosed in the present invention.

It should be understood that the drawings are not necessarily to scale, and that the disclosed embodiments are illustrated diagrammatically, schematically, and in some cases in partial views. In certain instances, details which are not required or helpful for an understanding of the disclosed methods and apparatuses or which render other details difficult to perceive may have been omitted. It should be further understood that the following detailed description is merely exemplary and not intended to be limiting in its application or uses. As such, the present disclosure is for purposes of explanatory convenience only, and it will be appreciated that the disclosure may be implemented in numerous other ways, and within various systems and environments not shown or described herein.

DETAILED DESCRIPTION

Hereinafter the preferred embodiments of the present invention will be described in detail referring to the drawings. Although the drawings show the preferred embodiments of the present invention, it should be understood that the present invention can be realized by various forms but not limited to the embodiments herein. On the contrary, the purpose of providing the embodiments herein is to make the invention more thorough and complete, and convey the whole scope of the present invention to those skilled in the art.

Embodiment 1

FIG. 1 shows a block diagram of an embodiment of device 100 for monitoring behavior of listening to broadcast disclosed in the present invention. In this embodiment, the device 100 comprises: a transmitter 101 transmitting a characteristic audio signal which is modulated on a carrier signal; a collector 102 collecting an ambient sound; a detector 103 detecting whether the collected ambient sound contains the characteristic audio signal; and a determiner 104 determining whether a broadcast receiving apparatus receives the broadcasting channel corresponding to frequency of the carrier signal according to the result of the detector 103.

The embodiment is based on the principle that if the broadcast receiving apparatus is receiving a broadcasting channel, the broadcast receiving apparatus can also receive other audio signal with the carrier frequency consistent with the broadcasting channel. In this embodiment, the device 100 for monitoring behavior of listening to broadcast transmits characteristic audio signal which is modulated on carrier signals through the transmitter 101. Once the broadcast receiving apparatus receives the broadcasting channel corresponding to frequency of the carrier signal, the broadcast receiving apparatus will output this characteristic audio signal, and the characteristic audio signal should be included in the ambient sound which is collected by the collector 102. Therefore, when the detector 103 detects that the characteristic audio signal is in the collected ambient sound, the determiner 104 determines that the broadcast receiving apparatus receives the broadcasting channel which is corresponding to frequency of the carrier signal according to the detection result, so as to realize the monitoring of behavior of listening to broadcast.

Figure 2:
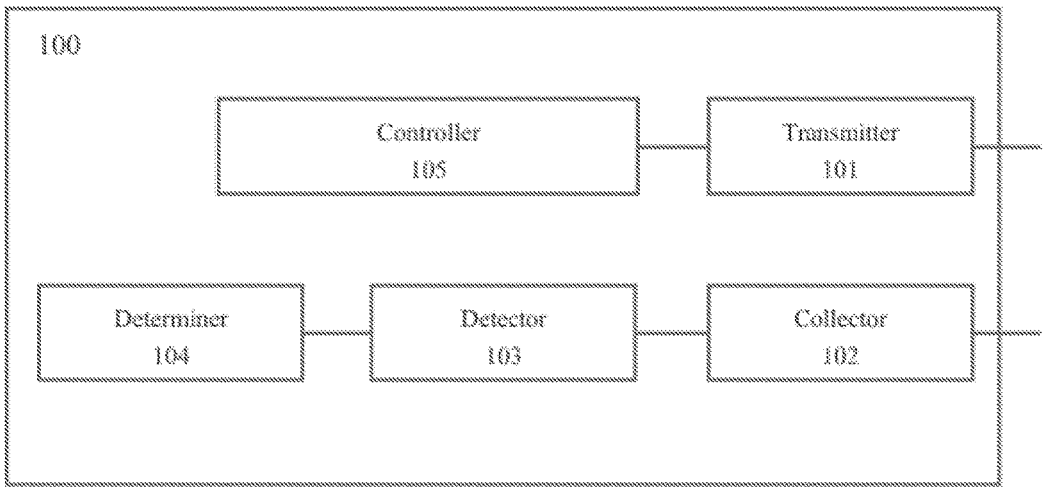
FIG. 2 shows a block diagram of an example of the device for monitoring behavior of listening to broadcast according to FIG. 1.

FIG. 2 shows a block diagram of an example of the device 100 for monitoring behavior of listening to broadcast according to FIG. 1. In this example, the device 100 for monitoring behavior of listening to broadcast can also include a carrier frequency controller 105, which can control the frequency of the carrier signal transmitted by the transmitted 101. The carrier frequency controller can be realized by various kinds of ways which are known to those skilled in the art. For example, the controller can be realized as a frequency generator generating carrier signals of different frequencies for being transmitted by the transmitter 101. In another example, the controller can generate a control signal, which controls the components for frequency generating in the transmitter 101 to generate carrier signals with different frequencies.

In a possible implement, the controller 105 can control the frequency of the carrier signal in a scanning mode. For example, the controller 105 can control the transmitter 101 to transmit carrier signals of various frequency points within FM/AM broadcast band (generally, FM broadcast band is from 64 MHz to 108 MHz, and AM broadcast band is from 520 KHZ to 1710 KHz) according to a certain frequency interval (such as according to each minimum step of FM/AM broadcast signal) and in a scanning mode. Through the aforesaid scanning mode, the behavior of listening to any channel of FM/AM broadcast band can be monitored. However, those skilled in the art should understand that the scanning mode is just an example but not a limitation to the present invention. For example, the controller 105 can also control the transmitter 101 to transmit several carrier signals with specified frequencies instead of in scanning mode, so as to monitoring the behavior of listening to the broadcasting channel corresponding to the specified frequencies.

Figure 3:
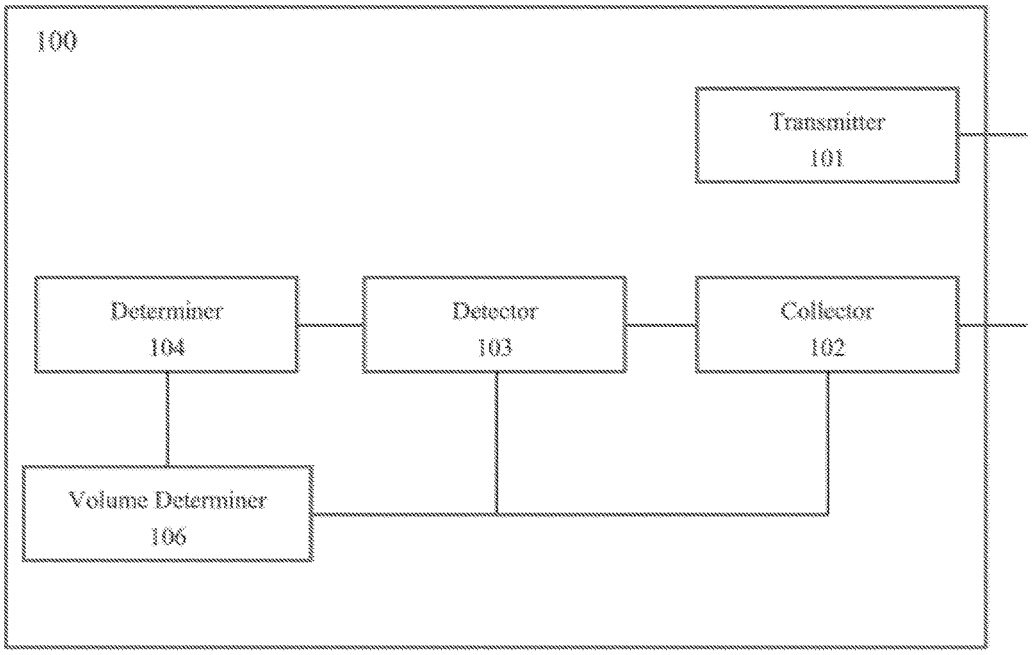
FIG. 3 shows a block diagram of another example of the device for monitoring behavior of listening to broadcast according to FIG. 1.

FIG. 3 shows a block diagram of another example of the device 101 for monitoring behavior of listening to broadcast according to FIG. 1. In this example, the device 101 for monitoring behavior of listening to broadcast can also include a volume determiner 106, which determines whether the output volume of the broadcast receiving apparatus is valid. For example, the volume determiner 106 can determine whether the output volume of the broadcast receiving apparatus is valid, when the detector 103 detects the characteristic audio signal, and notices the determiner 104 to ignore the detection result of the detector when the output volume is determined as invalid. That is to say, provided that the characteristic audio signals are detected and the broadcast receiving apparatus is determined as being receiving the broadcast channel, the volume determiner 106 will further judge whether the access to the broadcast is valid (i.e. the volume is high enough for user to listen to the broadcast) or invalid (i.e. the volume is not high enough for user to listen to the broadcast), and then ignore the invalid result.

For example, provided that the characteristic audio signal is detected by the detector 103, the volume determiner 106 can compare the volume of the background audio signals in the collected ambient sound except the characteristic audio signals with a reference volume, wherein the background audio signal may include the voice signal of the broadcasting which is output by the broadcast receiving apparatus at present, and the reference volume can be set up as needed by a person skilled in the art, for example, can be set as the volume of the sent characteristic audio signal. If the volume of the background audio signals is lower than the reference volume, the output volume of the broadcast receiving apparatus is determined as invalid. That is to say, through such a comparison, the volume determiner 106 can estimate whether the output volume of the broadcast receiving apparatus can be heard clearly by users. If the volume cannot be heard, the output volume of the broadcast receiving apparatus is determined as invalid, i.e., the access to this channel is invalid for the broadcast receiving apparatus, then the volume determiner 106 can notice the determiner 104 to ignore the result.

In an example, the characteristics audio signal can be modulated on carrier signal in the way of FM/AM, so as to be received by broadcast receiving apparatus which can receive FM/AM broadcasting signals.

In an example, the time for transmitting carrier signals of each frequency through the transmitter 101 can be shortened, such as within 100 ms, so that it cannot be noticed by users and will not influence the listening feeling of the broadcast receiving apparatus users. The time for transmitting can be controlled by the carrier frequency controller 105.

The transmitted power of the transmitter 101 can be set within the scope prescribed by the state, but it can be stronger than the broadcast signal in a certain distance range. In this case, the signals received by the broadcast receiving apparatus, the distance between which and the transmitter 101 is in the certain distance range, are mainly of the signals sent by the device of monitoring behavior of listening to broadcast, and the effective output of the speaker of the broadcast receiving apparatus is the characteristic audio signal.

In an example, the collector 102 can collect the ambient sounds according to a certain interval and in a sampling mode. In another example, the collector 102 can convert the ambient sounds to frequency domain signals through a way, such as FFT, for detecting by the detector 103. Those skilled in the art should understand that the converting the ambient sounds to frequency domain signals can also be done by the detector 103 or other additional modules. In another example, the collector 102 can further process the ambient sounds by reducing noise or filtering, in order to improve the accuracy of determination.

In an example, the detector 103 can use suitable means to detect whether the collected ambient sound contains the characteristics audio signals according to the features of the characteristics audio signal.

To understand this, an example for a kind of characteristic audio signal and its corresponding detection means are given below. Those skilled in the art should understand that the characteristics audio signal and the corresponding detection means are not limited to this, and it can be designed as needed. According to an example, the characteristic audio signal is composed of sine waves with different frequencies and modulated on carrier signals; then the characteristic audio signal is transmitted by the transmitter 101 and received by the broadcast receiving apparatus which is receiving the broadcasting channel corresponding to the frequency of the carrier signal; then the characteristic audio signal is output by the broadcast receiving apparatus and collected by the collector 102; the detector 103 detects whether the collected ambient sound contains signals with frequency-domain characteristic confirming to the characteristic audio signal; if yes, it should be determined that the collected ambient sound contains the characteristic audio signal.

In an example, the device 100 for monitoring behavior of listening to broadcast can include a generation module of characteristic audio signals to generate required characteristic audio signal. The characteristic audio signal generated by the generation module of characteristic audio signal can be modulated on carrier signal and transmitted by the transmitter 101. The process of modulation can be realized in the aforesaid components (such as the transmitter 101)) or in an independent modulation module through various means known by those skilled in the art. In an example, as a logic unit, the generation module of characteristic audio signal can generate digital characteristic audio signals, which can be converted to analog characteristic audio signal by a DAC for modulating and transmitting.

In an example, the detector 103 can determine the finial detection result via confirmation for many times. For example, after detecting that the ambient sound contains the characteristic audio signal for the first time, the detector 103 can indicate the carrier frequency controller to send the characteristic audio signal which is modulated on the same carrier signal once more, in order to detect and confirm again. For another example, after detecting that the ambient sound contains the characteristic audio signal for the first time, the detector 103 can indicate the carrier frequency controller and the generation module of characteristic audio not to generate the characteristic audio signal when this carrier frequency is scanned again, namely "mute", so as to only send the carrier signal and reduce influences on user's auditory feeling. Provided not detecting such situation of mute when this carrier frequency is scanned again, the detector 103 can indicate the carrier frequency controller and the generation module of characteristic audio to generate the characteristic audio signal which is modulated on the carrier signal with this frequency once more, in order to detect and confirm again.

In an example, the device 100 for monitoring behavior of listening to broadcast can include a user identity identification module and a listening time acquisition module. The user identity identification module can receive user identification information (such as signals of identification card) within a receiving range of the broadcast receiving apparatus, and identifies the identities of users in the receiving range according to the aforesaid user identification information. The listening time acquisition module can collect time for listening to a broadcasting channel, provided that the determiner 104 determines that the broadcast receiving apparatus receives the broadcasting channel corresponding to frequency of the carrier signal. The listening time can include the start time and end the time for listening.

In some application scenarios, the result of the determiner 104 can be recorded and analyzed, so as to obtain further information related to the behavior of listening to broadcast, such as information of listening ratio or listening time for specific broadcast channel by using the collected time for listening. In some other application scenarios, information of who and when listening to which channel can be obtained by combining with the identified user's identification information. The device 100 for monitoring behavior of listening to broadcast can include a processor which conducts the statistics and analysis. The device 100 for monitoring behavior of listening to broadcast can also include communication module which sends the data (such as results of the determiner and/or user's identification from the user identity identification module) used for statistics and analysis to a server, and then the server can perform the statistics and analysis.

Embodiment 2

Figure 4:
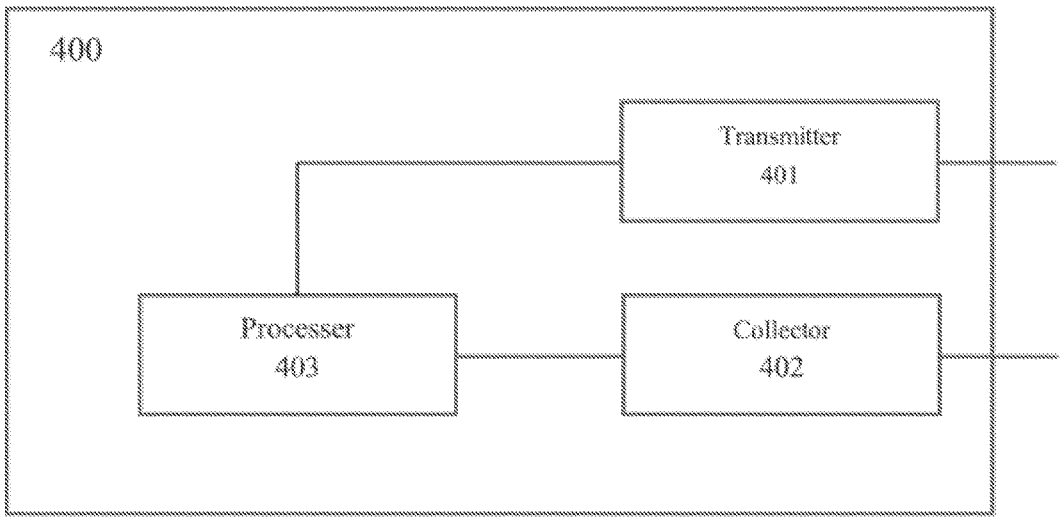
FIG. 4 shows a block diagram of another example of the device for monitoring behavior of listening to broadcast disclosed in the present invention.

FIG. 4 shows a block diagram of another embodiment of the device 400 for monitoring behavior of listening to broadcast disclosed in the present invention. In this embodiment, the device 400 comprises: a transmitter 401 transmitting a characteristic audio signal which is modulated on a carrier signal; a collector 402 collecting a ambient sound; a processor 403 detecting whether the collected ambient sound contains the characteristic audio signals; and determining whether a broadcast receiving apparatus receives the broadcasting channel corresponding to frequency of the carrier signal according to the result of the detecting.

In an embodiment, the transmitter 401 and the collector 402 can be realized in the similar way with that of the transmitter 101 and the collector 102 in the embodiment 1, while the processing module 403 can be realized through programmable devices, such as MCU, FPGA and microprocessor.

In an example, the processor can control the frequency of carrier signal which is transmitted by the transmitter.

In an example, the processor can control the transmitter to transmit carrier signals of various frequency points within FM/AM broadcast band according to a certain frequency interval and in a scanning mode. However, those skilled in the art should understand that the scanning mode just is an example but not a limitation to the present invention. For example, the processor can also control the transmitter to send several carrier signals of certain frequencies not in scanning mode, so as to monitoring the behavior of listening to the broadcasting channels corresponding to the certain frequencies.

In an example, the processor can determine whether the output volume of the broadcast receiving apparatus is valid in the case that the characteristic audio signal is detected, and ignores the result of detecting, if the output volume is determined as invalid.

In an example, provided that the processor detects the characteristic audio signal, the processor can compare the volume of a background audio signal in the collected ambient sound except the characteristic audio signal with a reference volume, and determines the output volume of the broadcast receiving apparatus as invalid if the volume is below the reference volume.

In an example, the characteristic audio signal can be composed of sine waves with different frequencies; the processor can detect whether the collected ambient sound contains a signal of frequency-domain characteristic conforming to the characteristic audio signal, and determines the collected ambient sound as containing the characteristic audio signal if the collected ambient sound contains a signal of frequency-domain characteristic conforming to the characteristic audio signal.

In an example, the processing module can determine the finial detection result via confirmation for many times. For example, after detecting that the ambient sound contains the characteristic audio signal for the first time, the processor can send the characteristic audio signal which is modulated on the same carrier signal once more, in order to detect and confirm again. For another example, after detecting that the ambient sound contains the characteristic audio signal for the first time, the processor can indicate not to generate the characteristic audio signal when this carrier frequency is scanned again, namely "mute", so as to only send the carrier signal and reduce the influences on user's auditory feeling. Provided not detecting the situation of mute when this carrier frequency is scanned again, the processor can indicate to generate the characteristic audio signal which is modulated on the carrier signal with this frequency once more, in order to detect and confirm again.

In an example, the processor can identify users in the receiving range of the broadcast according to the user identification information; and/or the processor can be configured to collect time for listening to a broadcasting channel when determining that the broadcast receiving apparatus receives the broadcasting channel corresponding to frequency of the carrier signal.

In an example, the device for monitoring behavior of listening to broadcast can comprise a communication module, which sends the result of the processor and/or the identified identity of users and/or the collected listening time to a server for statistical analysis.

Embodiment 3

Figure 5:
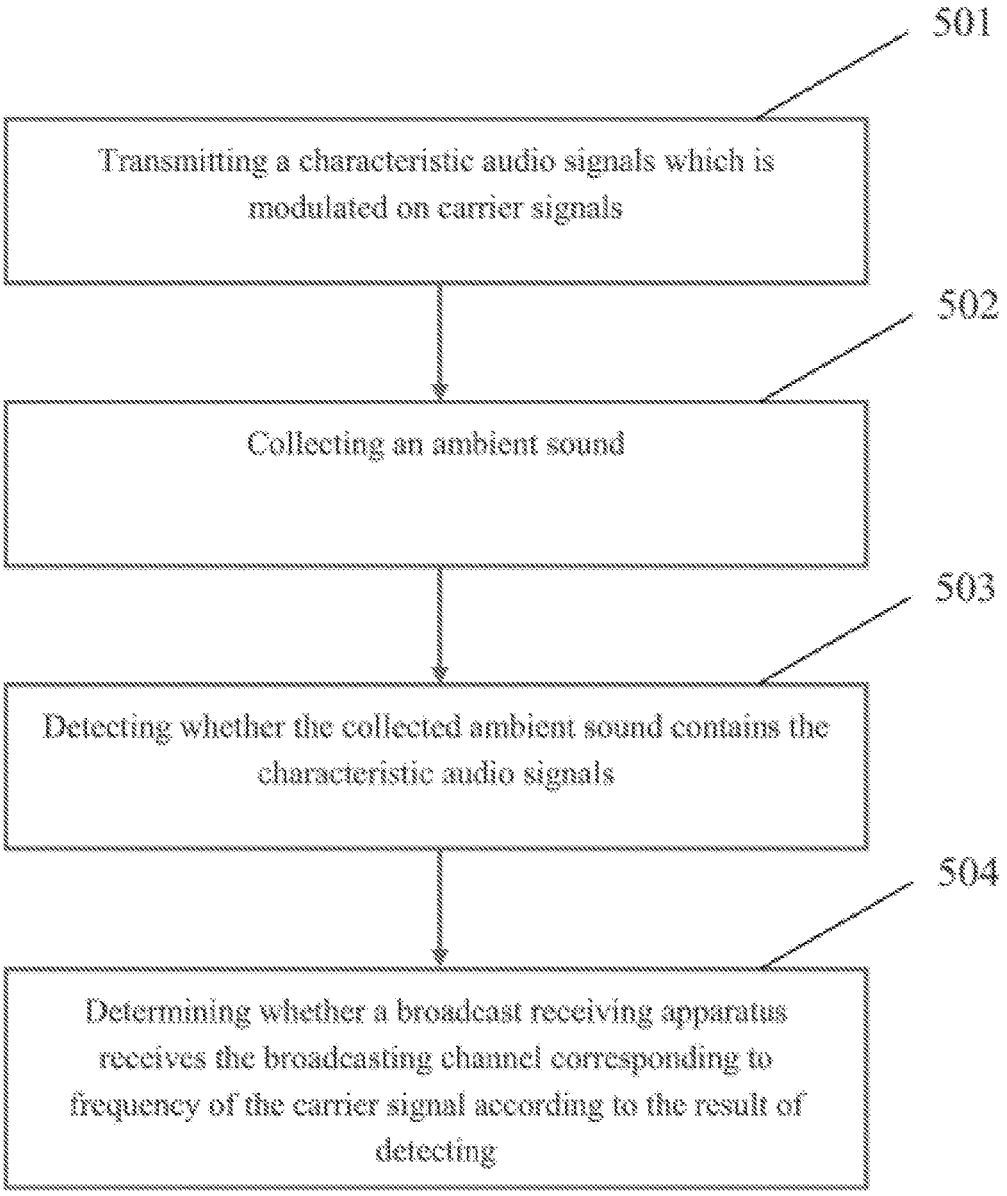
FIG. 5 shows a flow chart of an embodiment of the method of monitoring behavior of listening to broadcast disclosed in the present invention.

FIG. 5 shows a flow chart of an embodiment of the method of monitoring behavior of listening to broadcast disclosed in the present invention, and the method comprises: step 501 of transmitting a characteristic audio signal which is modulated on a carrier signal; step 502 of collecting an ambient sound; step 503 of detecting whether the collected ambient sound contains the characteristic audio signal; and step 504 of determining whether a broadcast receiving apparatus receives the broadcasting channel corresponding to frequency of the carrier signal according to the result of detecting.

In an example, transmitting a characteristic audio signal which is modulated on a carrier signal can include: transmitting carrier signals of various frequency points within FM/AM broadcast band according to a certain frequency interval and in a scanning mode.

In an example, this method can further include: determining whether the output volume of the broadcast receiving apparatus is valid in the case that the characteristic audio signals is detected; and ignoring the result of detecting if the output volume is determined as invalid.

In an example, determining whether the output volume of the broadcast receiving apparatus is valid can include: comparing the volume of a background audio signals in the collected ambient sound except the characteristic audio signal with a reference volume when the characteristic audio signal is detected; determining the output volume of the broadcast receiving apparatus as invalid if the volume is below the reference volume.

Application Example

In order to understand the solutions and effects of embodiments of the present invention easily, a specific application example is given as follow. Those skilled in the art should understand that this application example is only for understanding the present invention, wherein any specific detail does not intend to limit the present invention in any way.

In an application scenario, the device for monitoring behavior of listening to broadcast can be placed round a radio, and it detects the received broadcasting channel, and the time or duration for listening to the channel automatically through sending characteristic audio signal which is modulated on various carrier signals. This device can upload the data to the server automatically, and realizes the statistic of the listening ratio after the server performs statistical analysis on the data in the background, without intervention and operation by users during the whole process.

All aspects of the present invention are described herein according to the method, device (system) and the flow chart and/or the block diagram of computer program product in embodiments of the present invention. It should be understood that every square frame and/or every combination of any square frames of the flow chart and/or the block diagram can be realized by instructions of computer-readable program.

The instructions of computer-readable program can be provided to general purpose computer, special purpose computer and other processors of programmable data processing device, so as to produce a machine, which makes the instructions produce the device that can realize the function/or action stipulated by one or more square frames in the flow chart and/or the block diagram when computers or other processors of programmable data processing devices perform the instructions. The instructions of computer-readable program can also be stored in a computer readable storage medium, and the instructions make a computer, other processor of programmable data processing device or other device work in a specific manner. Thus, the computer readable storage medium storing instructions includes a manufacture, which contains all aspects of instructions to realize the function/or action stipulated by one or more square frames in the flow block and/or the block diagram.

The instructions of computer-readable program can also be loaded on a computer, other processor of programmable data processing device or other device to perform a series of steps on the computer, other processor of programmable data processing device or other device, so as to produce the process of realization of the computer. Then the instructions performs on the computer, other processor of programmable data processing device or other device realizes the function/or action stipulated by one or more square frames in the flow chart and/or the block diagram.

The flow chart and/or the block diagram of the drawings show systems and methods in multiple embodiments and the possible realized system structure, function and operation of the computer program product according to this present invention. In this regard, every square frame of the flow chart or the block diagram represents a module, program segment or part instruction, wherein the module, program segment or part instruction contains one or more executable instructions for realizing the stipulated logical function. In some alternative embodiments, the marked function in the square frame can also be realized in a different order from that marked in the drawings. For example, two consecutive square frames can perform substantially simultaneously and in parallel in fact, and also can perform in the reverse order. Please note that every square frame and/or every combination of any square frames of the flow chart and/or the block diagram can be realized by a dedicated system based on the hardware which perform prescriptive function or action, or by a combination of dedicated hardware and computer instruction. Each module can be realized independently, and any integrated combination of the modules can be realized.

Some embodiments of the present invention have been described above. The above description is exemplary but not exhaustive, and the present invention is not limited to the disclosed embodiments. Many modifications and variations will be apparent to those of ordinary skilled in the art, without departing from the scope and spirit of the above embodiments. To choose the terms used in this article is aimed at best explaining principles of embodiments, practical applications or technical revamping of Technologies in the market, or having others of ordinary skilled in the art understand the disclosed embodiments in this article.

What is claimed is:

1. A device for monitoring behavior of listening to broadcast, comprising:

a transmitter transmitting a characteristic audio signal which is modulated on a carrier signal;

a collector collecting an ambient sound; a detector detecting whether the collected ambient sound contains the characteristic audio signal;

a determiner determining whether a broadcast receiving apparatus receives the broadcasting channel corresponding to frequency of the carrier signal according to the result of the detector; and a volume determiner determining whether the output volume of the broadcast receiving apparatus is valid in the case that the characteristic audio signal is detected by the detector; and noticing the determiner to ignore the result of the detector when the output volume is determined as invalid;

wherein when the characteristic audio signal is detected by the detector, the volume determiner compares the volume of a background audio signal in the collected ambient sound except the characteristic audio signal with a reference volume and if the volume of the background audio signal is below the reference volume, the volume determiner determines the output volume of the broadcast receiving apparatus as invalid.

2. The device for monitoring behavior of listening to broadcast according to claim 1, comprising:

a carrier frequency controller controlling the frequency of the carrier signal which is transmitted by the transmitter.

3. The device for monitoring behavior of listening to broadcast according to claim 2, wherein the carrier frequency controller controls the transmitter to transmit carrier signals of various frequency points within FM/AM broadcast band according to a certain frequency interval and in a scanning mode.

4. The device for monitoring behavior of listening to broadcast according to claim 1, wherein the characteristic audio signal is composed of sine waves with different frequencies; the detector detects whether the collected ambient sound contains a signal with frequency-domain characteristic conforming to the characteristic audio signal, and determines the collected ambient sound as containing the characteristic audio signal if the collected ambient sound contains a signal with frequency-domain characteristic conforming to the characteristic audio signal.

5. The device for monitoring behavior of listening to broadcast according to claim 1, further comprising a user identity identification module and/or a listening time acquisition module;

the user identity identification module receives user identification information within a receiving range of the broadcast receiving apparatus, and identifies the identities of users in the receiving range according to the information;

the listening time acquisition module collects time for listening to a broadcasting channel, provided that the determiner determines that the broadcast receiving apparatus receives the broadcasting channel corresponding to the frequency of the carrier signal.

6. The device for monitoring behavior of listening to broadcast according to claim 5, further comprising:

a communication module, sending the results of the determiner and/or the identified identity of users and/or the collected time for listening to a server for statistical analysis.

7. A device for monitoring behavior of listening to broadcast, comprising:

a transmitter transmitting a characteristic audio signal which is modulated on a carrier signal;

a collector collecting a ambient sound; and a processor detecting whether the collected ambient sound contains the characteristic audio signals, and determining whether a broadcast receiving apparatus receives the broadcasting channel corresponding to frequency of the carrier signal according to the result of the detecting, wherein the processor determines whether the output volume of the broadcast receiving apparatus is valid in the case that the characteristic audio signal is detected, and ignores the result of detecting, if the output volume is determined as invalid; and when the characteristic audio signal is detected, the processor compares the volume of a background audio signal in the collected ambient sound except the characteristic audio signal with a reference volume; and determines the output volume of the broadcast receiving apparatus as invalid if the volume is below the reference volume.

8. A device for monitoring behavior of listening to broadcast according to claim 7, wherein the processor controls frequency of the carrier signal which is transmitted by the transmitter.

9. A device for monitoring behavior of listening to broadcast according to claim 8, wherein the processor controls the transmitter to transmit carrier signals of various frequency points within FM/AM broadcast band according to a certain frequency interval and in a scanning mode.

10. A device for monitoring behavior of listening, to broadcast according to claim 7, wherein the characteristic audio signal is composed of sine waves with different frequencies; the processor detects whether the collected ambient sound contains a signal of frequency-domain characteristic conforming to the characteristic audio signal, and determines the collected ambient sound as containing the characteristic audio signal if the collected ambient sound contains a signal of frequency-domain characteristic conforming, to the characteristic audio signal.

11. A device for monitoring behavior of listening to broadcast according to claim 7 wherein the processor identifies users in the receiving range of the broadcast according to the user identification information; and/or the processor is configured to collect time for listening to a broadcasting channel when determining that the broadcast receiving apparatus receives the broadcasting channel corresponding to frequency of the carrier signal.

12. A device for monitoring behavior of listening to broadcast according to claim 11, further comprising:

a communication module, sending the result of the processor and/or the identified identity of users and/or the collected time for listening to a server for statistical analysis.

13. A method of monitoring behavior of listening to broadcast, comprising:

transmitting a characteristic audio signal which is modulated on a carrier signal;

collecting an ambient sound;

detecting whether the collected ambient sound contains the characteristic audio signal; and determining whether a broadcast receiving apparatus receives the broadcasting channel corresponding to frequency of the carrier signal according to the result of detecting; determining whether the output volume of the broadcast receiving apparatus is valid in the case that the characteristic audio signals is detected; and ignoring the result of detecting if the output volume is determined as invalid;

determining whether the output volume of the broadcast receiving apparatus is valid includes: comparing the volume of a background audio signals in the collected ambient sound except the characteristic audio signal with a reference volume when the characteristic audio signal is detected; determining the output volume of the broadcast receiving apparatus as invalid if the volume is below the reference volume.

14. The method of monitoring behavior of listening to broadcast according to claim 13, wherein transmitting a characteristic audio signal which is modulated on a carrier signal includes: transmitting carrier signals of various frequency paints within FM/AM broadcast hand according to a certain frequency interval and in a scanning mode.

* * * * *